United States Patent [19]

Brickman

[11] 4,122,780

[45] Oct. 31, 1978

[54] FOLDABLE BAR-TABLE

[75] Inventor: Harold Brickman, Chicago, Ill.

[73] Assignee: Ever-Wear, Inc., Chicago, Ill.

[21] Appl. No.: 844,610

[22] Filed: Oct. 25, 1977

[51] Int. Cl.[2] ..... A47B 85/00

[52] U.S. Cl. ..... 108/25; D6/144; D6/179; D7/71; 211/85

[58] Field of Search ..... 211/85, 72, 71, 74; 224/45 A, 45 P, 45 Q, 55; 312/140.2; 248/166, 164; 297/192, 188; D6/178, 179, 188, 144; D7/52, 71; 108/25

[56] References Cited

U.S. PATENT DOCUMENTS

| | | | |
|---|---|---|---|
| D. 188,522 | 8/1960 | Perda | D6/188 |
| D. 242,203 | 11/1976 | Falbo | D7/52 |
| 2,122,042 | 6/1938 | Mattucci | 312/140.2 |
| 2,500,035 | 3/1950 | Hollander | 108/25 |
| 2,822,968 | 2/1958 | Jackson | 297/188 |
| 3,122,397 | 2/1964 | Mintz | 248/164 X |
| 3,298,737 | 1/1967 | Rosenfeld et al. | 297/192 |
| 3,415,572 | 12/1968 | Zagwyn | 297/192 |

FOREIGN PATENT DOCUMENTS

| | | | |
|---|---|---|---|
| 1,165,671 | 6/1958 | France | 297/188 |

*Primary Examiner*—James T. McCall
*Attorney, Agent, or Firm*—McDougall, Hersh & Scott

[57] ABSTRACT

A foldable bar-table formed of a pair of frame members mounted for relative rocking movement between open and folded positions and vertically spaced apart non-stretchable fabrics extending lengthwise between the cross pieces of the frame members with openings in the upper fabric to enable containers to be inserted therethrough and supported by the lower fabric, including side pockets for utensils and depending compartments for containers.

6 Claims, 4 Drawing Figures

FOLDABLE BAR-TABLE

This invention relates to a portable folding bar and, more particularly, to a collapsible bar of the type described in which the bar equipment and bottles can be easily and safely stored and made available for immediate use.

Ordinarily, the bar equipment and bottles are stored in cabinets from which they must be removed for use and replaced for storage, and for which special holders must be provided in the event of use on unstable supports, such as on shipboard of other transport facilities. The need for such storage space and equipment makes it difficult, time consuming and laborious to serve drinks and beverages on moving transports, such as trailers, ships, trains and the like, the oftentimes accidents occur due to spillage.

It is an object of this invention to provide a foldable bar which can be easily transported from place to place for use, which can be folded in a simple and efficient manner into a compact unit that can be stored in any convenient locker or space with the bottles of beverage, glasses and other bar equipment remaining with the folded unit for safe storage, which can be carried to any desirable location and unfolded to provide an open bar on which the beverage bottles and bar equipment become exposed in a stable and safe manner for immediate use in the preparation of drinks and the like, without the need for additional equipment and support, and in which the open bar can be used as a bar table for holding the beverage containers or for the service of food and/or appetizers to be provided with the beverage or otherwise.

Figure 1:
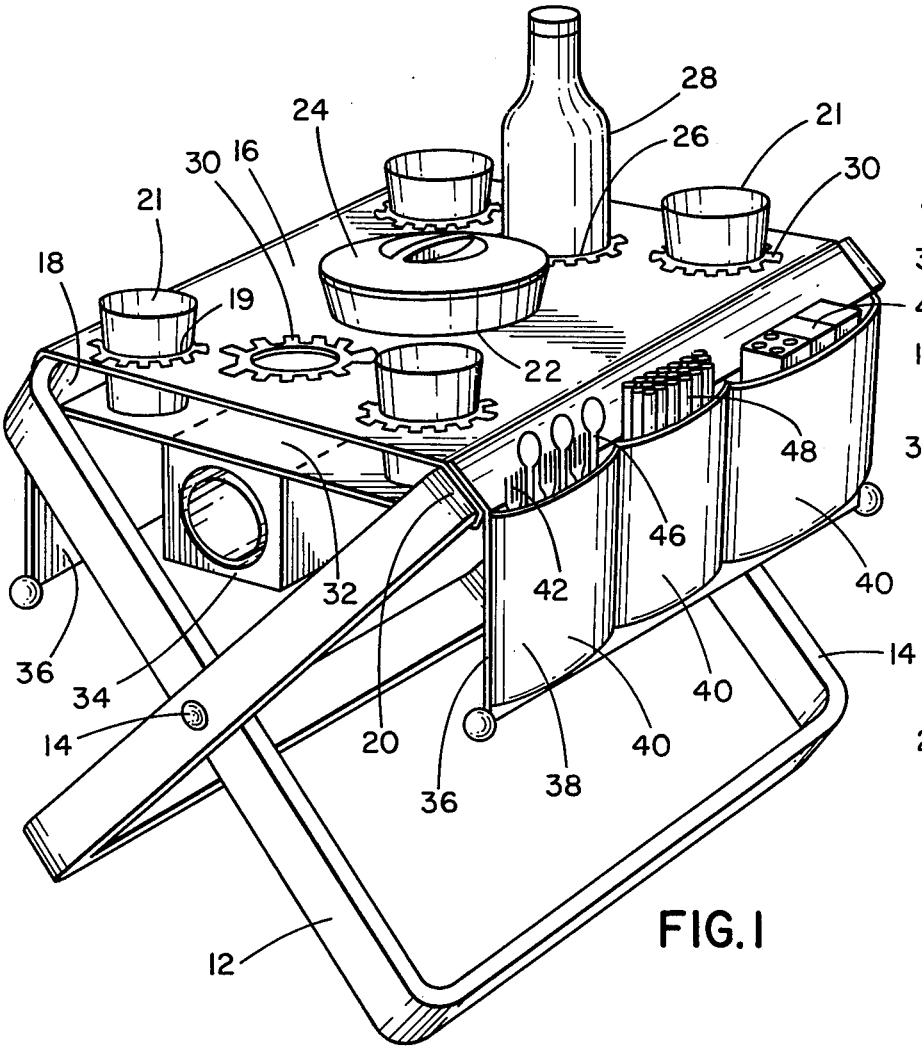
Figure 4:
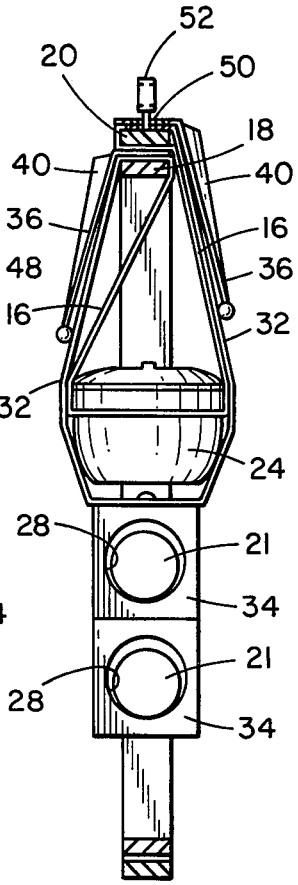
Figure 2:
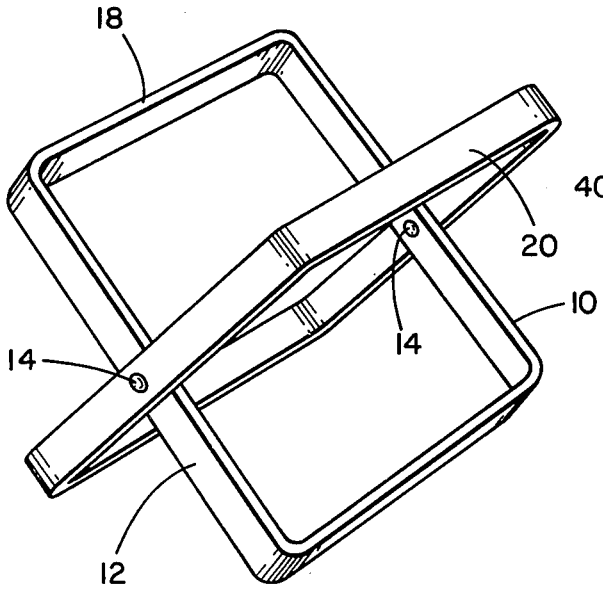
Figure 3:
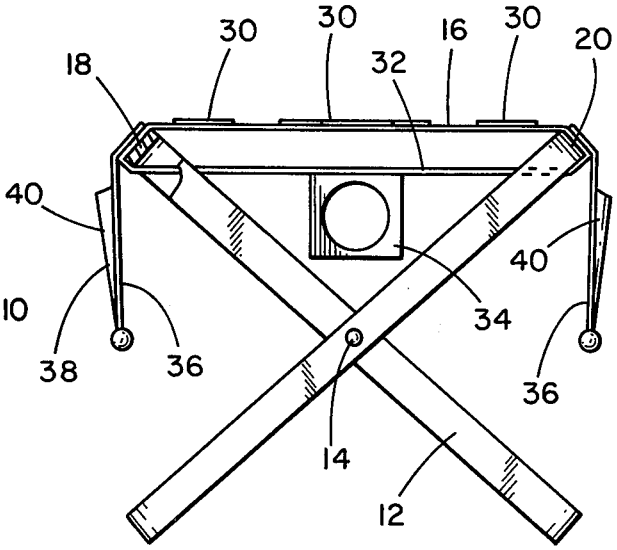

These and other objects and advantages of this invention will hereinafter appear, and for purposes of illustration, an embodiment of the invention is shown in the accompanying drawing in which:

FIG. 1 is a perspective elevational view of an open bar embodying the features of this invention, FIG. 2 is a perspective view of a new and novel frame member which has been used as the frame members of the foldable bar shown in FIG. 1, FIG. 3 is a side elevational view of the foldable bar shown in FIG. 1 with the bottles and equipment removed, and FIG. 4 is a side elevational view of a modification of the foldable bar of FIG. 1 in folded position.

In the illustrated modification, the foldable bar is formed of a pair of rectangular open frame members 10 and 12 formed of wood, metal, plastic or the like structural materials, and preferably formed by wrapping paper about a rectangular block with bonding adhesive to form a rectangular tube which can be cut crosswise for sectioning into rectangular strips, to provide low cost frame members having good structural strength.

One of the frame members 12 is formed of lesser width than the other to enable the one to be inserted between the legs of the other for joinder intermediate their ends by pivot pins 14, which enables the open frame members to be rocked relative to each other about a common axis. It will be understood that instead of making use of frame members of rectangular shape, use can be made of frame members of U-shape with the legs pivotally interconnected intermediate their ends and with the bail portions extending crosswise between the upper ends of the legs.

A flexible, non-stretchable fabric, such as a fiber filled plastic or woven cloth 16 extends lengthwise between the upper cross pieces 18 and 20 of the frame members and is secured thereto by suitable fastening means, such as clips, brads, nails, adhesives, stitching, or combinations thereof to span the space between the cross pieces for limiting the movement of the cross pieces in the direction away from each other, thereby to define the open position.

As shown in FIG. 1, the fabric top 16 is formed with openings of different dimensions and shapes depending upon the cross section and shape of the containers, bottles, glasses and the like to be retained therein, with the arrangement of the openings depending upon the desired location of the glasses, bottles, ice buckets, containers and the like on the open bar. For example, in the illustrated modification, a cutout opening 19 is provided in each of the corner sections dimensioned to enable a glass 21 to extend partway therethrough; an opening of larger dimension is provided in the center 22 to enable the bottom end portion of a bowl or ice bucket 24 to be seated therein, and with cutout openings 26 aligned crosswise of the center line dimensioned to enable a bottle or bottles 28 to extend therethrough.

While the openings can be cut out from the fabric or molded into the panel, it is preferred to slit and fold back portions of the material, as illustrated by the tabs 30, to function as reinforcement for material adjacent the openings and to provide for a degree of stiffening for better support. Another fabric 32, free of openings, is stretched between and secured to the cross piece members 18 and 20 when in unfolded or open position, with the fabric spaced a short distance below the top panel 16. Thus the bottom panel 32 functions as a stop on which the glasses, bottles or containers extending through the openings in the top panel can rest whereby the panel 32 serves to support the same while the upper panel serves to retain the bottles, glasses and containers in a stable upright position. The end portions of the upper and lower fabric 16 and 32 can be raised around the cross pieces 18 and 20 and stitched one to the other for attachment in the assembled relation, or the end portions can otherwise be secured in the manner described above for attachment to the cross pieces.

By way of modification, compartments having side openings can be secured to depend from the underside across the central portion of the lower panel 32. Such pockets or compartments 34 can be used to house bottles of beverages therein or for storage of glasses when the unit is in the collapsed position. One or more such vertically aligned pockets can be provided of fabric material stitched at their upper end to the lower panel.

Having described the basic structure, it will be seen by reference to FIG. 4, that when the foldable bar is collapsed, the central portion of the fabric supporting the ice chest and bottles drops below the folded cross pieces 18 and 20 and remains concealed between the adjacent side portions of the fabric to be retained thereby in an upright, safe and protected position, while all the glasses and other bottles can be inserted into the pockets 34, preferably before folding, thereby to be concealed and protected by the side pieces of the folded frame members and the fabric of which the pockets are formed.

Thus the foldable bar can be picked up and stored with all of the utensils fully concealed. When it is desired to make use of the foldable bar, it is only necessary to carry the unit to the location desired for use, and then unfold the frame members to make the bottles and ice chest available in position of use, and with the pockets exposed for the removal of glasses, additional bottles or the like elements stored in the pockets.

By way of further modification, the top fabric 16 can be extended to be draped over the cross pieces and forward a skirt portion 36 which depends from the cross pieces with additional fabric 38 stitched or otherwise adhered to one or both of the skirts to provide one or more pockets 40 in which various utensils such as forks 42, knives 44, spoons 46 and straws 48, and the like can be stored.

If desired, the other skirt 36 can be provided with similar pockets for storage of equipment or, more desirably, left free so it can serve as a flap to be folded over the unit when in collapsed position to cover the top of the folded frame members and extend downwardly over the opposite side to cover the pockets 40 housing the utensils.

The folded flap portion can advantageously be provided with a central opening 50 to enable a handle 52, attached to the center of a cross piece member to extend therethrough so that the unit can be carried by the frame members and thereby to relieve the fabric and containers of any strain when the unit is carried from place to place in the collapsed position. A housing handle can be provided at the center of each cross piece for balance when the foldable bar is carried in the collapsed position.

It will be understood that changes may be made in the details of construction and arrangement of the various pockets and openings, without departing from the spirit of the invention, especially as defined in the following claims.

I claim:

1. A foldable bar-table comprising a pair of frame members, each member of the pair having a pair of laterally spaced apart legs and a cross piece joining the upper end portions of the legs, pivotal means interconnecting intermediate portions of the legs of one frame member with the corresponding intermediate portion of the legs of the other frame member to enable relative rocking movement of the frame members about a pivotal interconnection between open and folded positions, upper and lower fabrics of flexible, non-stretchable material extending crosswise between the cross pieces and dimensioned to have a length corresponding to the spaced relation between side cross pieces when in open position, the lower fabric being spaced a short distance below and substantially in parallel relation with the upper fabric when in open position, openings in the upper fabric dimensioned to correspond with the cross section of containers to be retained thereby whereby said containers can extend through said openings into engagement for support by said lower fabric.

2. A foldable bar-table as claimed in claim 1, in which the ends of the upper and lower fabrics are attached to the cross pieces.

3. A foldable bar-table as claimed in claim 1, which includes one or more horizontally extending compartments having an open end adjacent a lateral edge of the lowermost fabric, in which the compartments are fixed to the bottom side of the lower fabric to depend from and extend lengthwise from the central portion of the lower fabric for displacement of storage containers endwise into and out of the compartment through the open end.

4. A foldable bar-table as claimed in claim 3, in which the compartments are formed of fabric material stitched to the underside of the lower fabric.

5. A foldable bar-table as claimed in claim 1 which includes a fabric extension that depends from one of the cross pieces, and pockets having access openings at the top secured to said fabric extension for retaining eating and bar utensils, and which includes a fabric extension beyond the other cross piece dimensioned to have a length to conceal the space between the cross pieces when folded over the cross piece in folded position.

6. A foldable bar-table as claimed in claim 5 which includes a handle member secured to the central portion of at least one of the cross pieces uppermost where in the folded position and an opening in the fabric extension aligned with the handle to enable the handle to project therethrough when the fabric is folded over the cross pieces when in folded position.

* * * * *